US005522439A

United States Patent [19]

Håkansson et al.

[11] Patent Number: 5,522,439

[45] Date of Patent: Jun. 4, 1996

[54] APPARATUS FOR FILLING CONTAINERS

[75] Inventors: Ivan Håkansson; Lajos Pethö, both of Limoges, France

[73] Assignee: AB IMIA Development, Huddinge, Sweden

[21] Appl. No.: 313,077

[22] PCT Filed: Mar. 26, 1993

[86] PCT No.: PCT/SE93/00260

§ 371 Date: Dec. 21, 1994

§ 102(e) Date: Dec. 21, 1994

[87] PCT Pub. No.: WO93/19985

PCT Pub. Date: Oct. 14, 1993

[30] Foreign Application Priority Data

Apr. 2, 1992 [SE] Sweden ..... 9201037

[51] Int. Cl.[6] ..... B65B 3/00

[52] U.S. Cl. ..... 141/244; 141/177; 141/178; 141/237

[58] Field of Search ..... 141/177–179, 141/184, 185, 234, 237, 238, 240, 242–246

[56] References Cited

U.S. PATENT DOCUMENTS

| | | | |
|---|---|---|---|
| 650,309 | 5/1900 | Denham | 141/237 X |
| 1,360,023 | 11/1920 | Risser | 141/245 |
| 2,791,353 | 5/1957 | Dorn et al. | 141/244 X |
| 5,105,859 | 4/1992 | Bennett et al. | 141/237 X |

FOREIGN PATENT DOCUMENTS

| | | |
|---|---|---|
| 382852 | 4/1987 | Austria . |
| 007653 | 2/1980 | European Pat. Off. . |
| 406092 | 1/1991 | European Pat. Off. . |
| 52152 | 2/1977 | Finland . |
| 2612168 | 9/1988 | France . |
| 2728759 | 1/1979 | Germany . |
| 440218 | 7/1985 | Sweden . |

*Primary Examiner*—J. Casimer Jacyna
*Attorney, Agent, or Firm*—Cushman Darby & Cushman

[57] ABSTRACT

For filling containers with a liquid product, the product is fed from a storage container to a manifold to which volume containers of given volumetric capacity are connected, and from which the product is fed to the containers. The outlets of the volume containers are fitted with point valves and the containers and the valves are blown clean by means of a stream of inert gas, so as to eliminate subsequent dripping of product therefrom. Remaining product which is not introduced into the volume containers is displaced by means of a gas stream to a collecting container and from there back to the storage container. The filled containers are advanced in a conveyor in a manner in which the containers are gently accelerated in their movement to a container sealing apparatus.

7 Claims, 6 Drawing Sheets

APPARATUS FOR FILLING CONTAINERS

BACKGROUND OF THE INVENTION

The present invention relates to apparatus for filling containers with liquid product. More specifically, the invention relates to apparatus for filling bottles with pharmaceutical preparation, such as a solution for intravenous administration. The invention also relates to filling containers with a liquid product with the aid of apparatus, and more specifically to filling bottles with a pharmaceutical preparation for intravenous administration.

When filling bottles and other types of container with pharmaceutical products, a complete filling process will include the following process stages:

1. A container washing stage.
2. A container sterilizing stage.
3. A bottle filling stage.
4. A container sealing stage.
5. A filled container sterilizing stage.

During these various process stages, the containers are exposed to the risk of contamination by bacteria and other microorganisms, the greatest risk in this regard being in stage 3, in which the bottle are filled with liquid product. The risks are greater in this particular process stage, because product tends to splash as it is poured into the bottles and also during the subsequent transportation of the bottles to the stopper fitting section of the apparatus, i.e. the bottle stoppering unit, and also because of subsequent dripping of product from the filling nozzles used. This splashing and subsequent dripping of the liquid product generates the risk of a thin liquid film forming between the stopper and the glass surface at the bottle neck, and therewith form a culture substrate for bacterial growth, which can spread to the product in the bottle concerned. Such bacteria growth can also occur when a layer of liquid is formed between the stopper and the capsule placed around the stopper. The actual container-filling stage is therefore a highly critical stage of the complete process.

The development of machines for filling containers with solutions for parenteral administration, and then particularly for intravenous administration, began in the 1950s, although the use of low capacity apparatus began somewhat earlier. At the present time, apparatus capable of filling containers with intravenous solutions at a rate of 4,000–5,000×100 ml/h are commercially available.

In the majority of cases, these known machines are based on the use of electronic control and operating units and are complicated and less reliable in use than is desired. Because of the electronics, the apparatus is highly sensitive to the stresses and strains to which a filling machine is subjected under normal operating conditions. Spillage can occur during a firing operation, and it is often necessary to thoroughly clean the machine, using large quantities of water and/or steam in the process. This can readily cause malfunctioning of the electronic devices, resulting in interruptions in machine operation.

Another drawback is found in the transportation of a filled bottle to the downstream stoppering unit. More often than not, the bottles are stationary as they are filled, but must then be moved to a bottle stoppering unit. This bottle transfer often involves abrupt acceleration of bottle movement, so as to adapt movement of the bottles to the rate at which the bottles are transported in the bottle stoppering unit, which often operates at a relatively high speed. Such abrupt acceleration of the bottles presents considerable risk of product splashing from the bottles.

SUMMARY OF THE INVENTION

The present invention eliminates the aforesaid drawbacks and provides a container-filling apparatus, and then particularly a bottle-filling apparatus, with which the risks of contamination by splashing and subsequent dripping of the liquid product is essentially eliminated. The apparatus is of simple construction and primarily utilizes vacuum and overpressure for the transportation of the liquid product, and only a minimum of electronic equipment. The apparatus also includes a filled container conveyor which is constructed so as to accelerate the containers gently from a stationary state to the transportation speed of the downstream stoppering unit.

As a result of its simple construction, the apparatus is also less expensive.

The invention thus relates to an apparatus for filling product containers, and then particularly bottles, with a liquid product, and is characterized in that it includes a) a generally horizontal manifold or branched pipe which is connected to a storage container for the delivery of product to be poured into the containers, and to a collecting container for collecting product that is not fed into the containers, and which manifold is provided with at least one outlet which leads to a connected volume container for introducing product into the product containers, wherein the volume containers are designed with a determined, adjustable volume which corresponds to the product volume to be introduced into each product container, and wherein the outlet ends of the volume containers are provided with point valves which adjust the outflow of product to the product containers, and wherein the outlet orifice of the manifold leading to the volume containers discharges on a level which lies above the bottom level of the manifold;

b) a product return line for returning product from the collecting container to the storage container;

c) sensor means which monitor the highest and the lowest permitted liquid levels in the manifold;

d) connections to a source of gas under overpressure, this gas functioning to expell liquid product from the volume containers to the product containers and to blow residues of product from the point valves, so as to transport remaining liquid product from the manifold to the collecting container and to transport liquid product from the collecting container to the storage container;

e) a conveyor for advancing product containers to be filled along a linear conveyor path and for delivering the filled product containers to a container sealing apparatus; and f) a program mechanism which receives impulses from the sensor means which detect the liquid level in the manifold, and also from sensor means which detect the positions of the product containers on the conveyor, and on the basis of these impulses functions to control the setting of valves in product and gas conduits and also to control the movement of the conveyor.

In a particularly preferred embodiment, the product containers are glass or plastic bottles and sealing of the bottles is effected with a stopper and optionally also with a capsule.

The apparatus of the invention advantageously can be used for practicing a method of filling product containers with a liquid product, comprising the steps of:

a) feeding the product containers into a conveyor and advancing the containers along a linear path, wherein movement of the containers is interrupted when the containers are located in a predetermined filling position;

b) feeding the liquid product from a storage container to a generally horizontal manifold to which there is connected at least one outlet of a volume container from which the product is passed to the product containers, the volume containers being designed with a determined, adjustable volume which corresponds to the product volume to be poured into each product container, and wherein the manifold outlet leading to the volume containers discharges at a level which lies above the bottom level of the manifold, and wherein the outlets of respective volume containers are closed by means of openable point valves;

c) subsequent to having filled the volume containers and the manifold to a level which lies above the level of the manifold outlet to the volume containers, interrupting the delivery of product from the storage container and leading away that part of the liquid which does not enter the volume containers but remains in the manifold to a product collecting container and then passing this remaining liquid product back to the storage container through a return line;

d) opening the point valves at the outflow ends of the volume containers so that liquid product will flow out into the product containers, whereafter a stream of gas is passed through the volume containers and the point valves to purge the containers and said valves from product residues;

e) restarting the conveyor and conveying the filled product containers along a path which is connected to a product container sealing apparatus, such that the filled product containers will be accelerated smoothly to a speed which is adapted to the container advancing speed of the container sealing apparatus, and feeding the containers into and sealing said containers in said apparatus; and f) repeating steps a) to e) in sequence a desired number of times.

The term "liquid product" as used herein is meant to include pure liquids, solutions, emulsions and suspensions with viscosities that can vary within wide limits.

DETAILED DESCRIPTION

Figure 1:
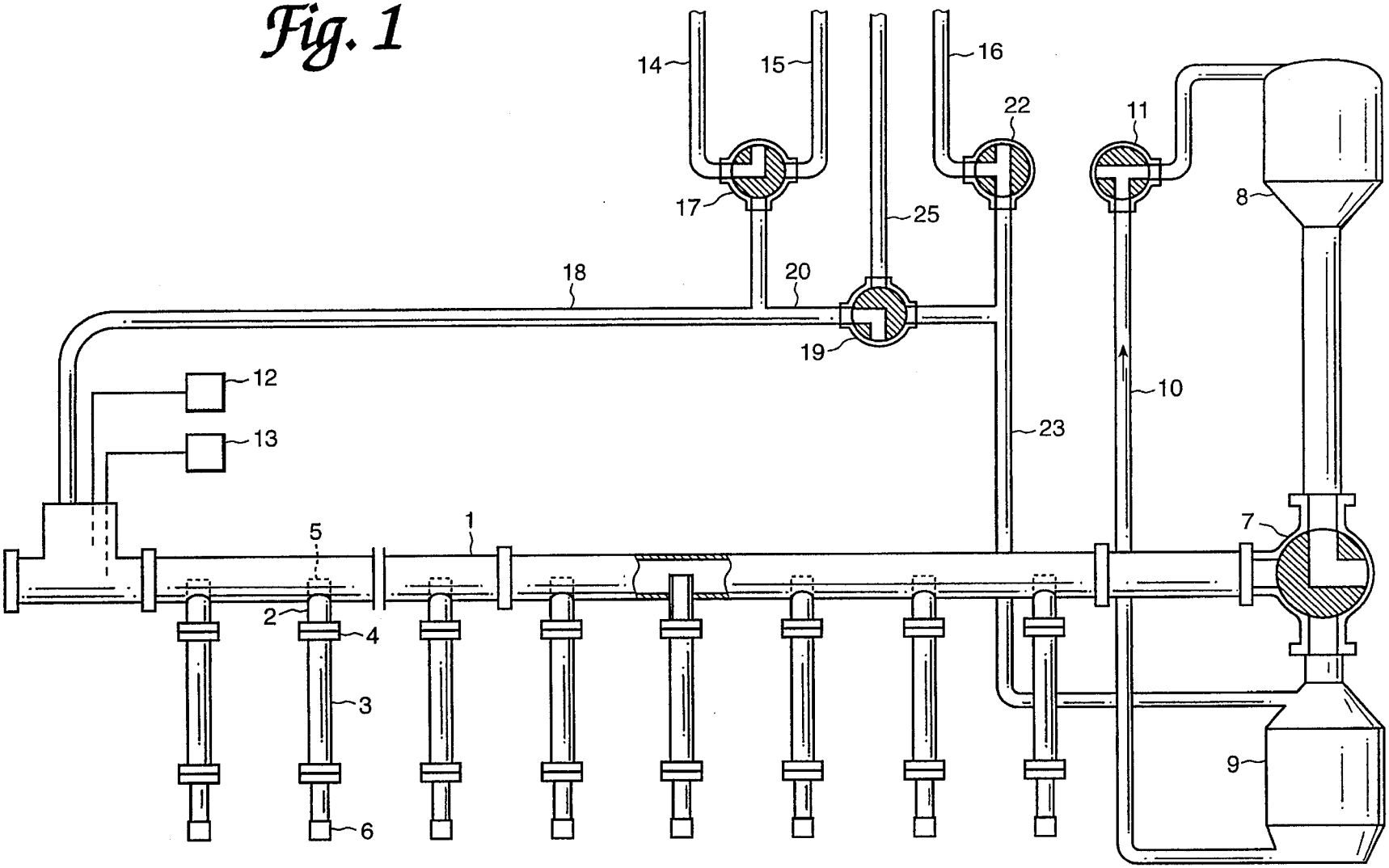
FIGS. 1–4 of the accompanying drawings illustrate the filling apparatus in the various stages of a filling process

The apparatus and the manner in which the apparatus operates will now be described in detail with reference to the accompanying drawings, in which like components have been identified by like reference signs.

FIGS. 1–4 illustrate schematically the construction of an apparatus according to the invention. The apparatus includes a manifold or branched pipe 1 to which there are connected outlet conduits 2 which conduct product to respective volume containers 3. Together with the outlet conduits 2, these volume containers 3 have a determined volume which corresponds to the volume of product to be introduced into the product containers (not shown). The volume containers 3 are connected to the outlet conduits 2 by means of flange connections 4, so as to enable volume containers of different volumetric capacities to be connected easily to the manifold 1, according to the volume of liquid to be introduced into the product containers. Alternatively, the volume containers may be of adjustable volume.

The inlet opening of the inlet end 5 of respective outlet conduits 2 lies on a level which is above the lowest level in the manifold 1. Thus, a given volume of liquid will always remain in the outlet conduit 2 and the volume container 3 when surplus product is removed from the manifold 1.

The outlet ends of the volume containers 3 are closed by means of openable point valves 6, which will be described in more detail in the following.

Connected to one end of the manifold 1 is a three-way valve 7 whose other two connections are connected respectively to a storage container 8 in which the liquid product is stored and to a product collecting container 9. A return pipe 10 fitted with a valve 11 extends between the collecting container 9 and the storage container 8.

The manifold 1 also includes a sensor 12 which functions to detect when the liquid in the manifold reaches the highest permitted level, and a sensor 13 which detects when liquid product is at the lowest permitted level. These level sensors are connected to a programme mechanism (not shown), the function of which will be described in more detail in the following.

The apparatus is connected to a gas source by pipes 14, 15 and 16, and then preferably to an inert gas source, such as nitrogen gas or argon at a suitable pressure above atmospheric pressure. The pipes 14 and 15 are connected to a three-way valve 17, the third connection of which is connected to a pipe 18 which leads to the manifold 1, and also to a three-way valve 19 by means of a pipe 20.

The inert gas inlet pipe 16 is connected to a valve 22 and, via said valve, to a pipe 23 which leads to the collecting container 9. The pipe 23 includes a manifold 24 which leads to the three-way valve 19. The third connection of the three-way valve 19 is connected to a pipe 25 which leads to atmosphere.

Figure 5:
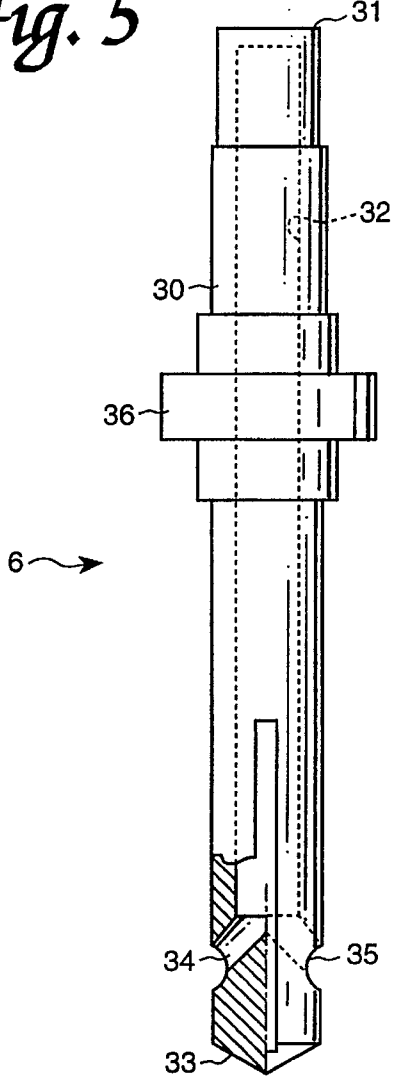

FIG. 5 is a schematic, partly sectional view of one embodiment of a point valve 6. The valve has the form of a tube 30 which is provided at its inlet end 31 with a suitable connection for coaction with the outlet end of a volume container 3. This connection may be a screw-thread connection, a flange connector or the like, and is not shown in detail. The tube 30 includes a coaxial passageway 32 extending from the inlet end 31. This passageway 32 does not extend through the whole of the tube, but is terminated close to the outlet end 33 by two channels 34, 35 which connect the passageway 32 with the outside.

Fitted around the tube 30 is a sleeve 36 which can be slid along the tube 30. When the sleeve is located in an upper position, the position shown in the Figure, the outlets of the two channels 34 and 35 are free and liquid or gas is able to flow freely through the passageway 32 and out through the channels 34 and 35. On the other hand, when the sleeve 36 is moved down to a position in which it covers the outlet openings of the channels 34 and 35, the liquid outlet, or the gas outlet, is closed. It will be understood that the internal diameter of the sleeve must be adapted accurately to the outer diameter of the tube 30, so as to obtain an effective seal. It must be possible to maintain this sealing effect over a long period of time despite the very large number of times that the sleeve 36 is moved up and clown the tube 30. A ceramic sleeve has been found suitable in this respect, since ceramic materials are highly wear-resistant and can be worked to very close tolerances.

Figure 7:
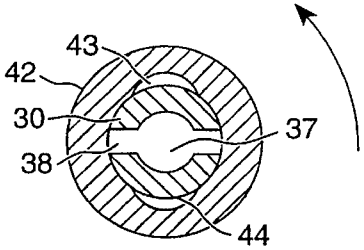
FIGS. 5–7 illustrate different constructions of the point valve fitted at the outlet ends of the volume containers
Figure 6:
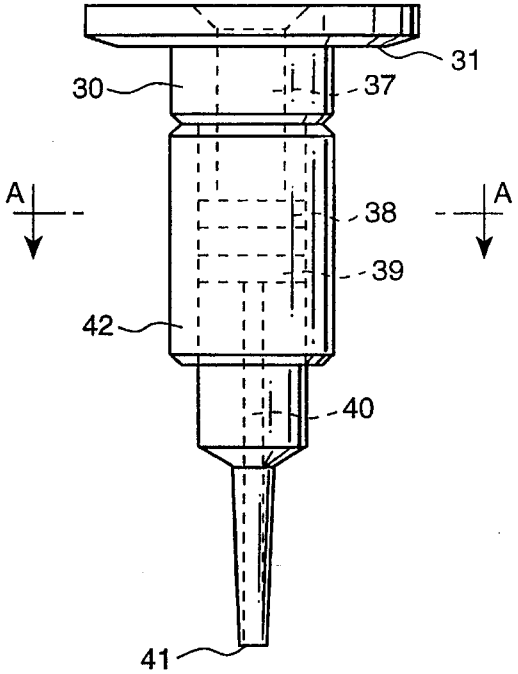

FIGS. 6 and 7 illustrate an alternative embodiment of the pointed valve 6. FIG. 6 is a top view of the valve seen from one side, and FIG. 7 is a sectional view taken along the line A—A in FIG. 6.

This valve also has the form of a tube 30 provided with a volume container 3 connection means at its inlet end 31. The connection means of the embodiment illustrated in FIGS. 6 and 7 is a flange connector.

The tube 30 is provided with a coaxial passageway 37 which extends from the inlet end 31 to a first transverse channel 38 which opens in the side wall of the tube 30. A second transverse channel 39 is provided slightly downstream of the first channel 38 and also opens in the side wall of the tube 30. This second channel is connected to a channel 40 which is coaxial with the tube 30 and the passageway 37 and opens out at the outlet end 41 of the tube 30.

Fitted to the outside of the tube 30 is a sleeve 42 which can be rotated around said tube but not moved longitudinally therealong. The sleeve 42 covers the outlet orifices of the two transverse channels 38 and 39 and is configured to seal against the outer wall of the tube 30.

The inner surface of the sleeve 42 is provided with recesses 43 and 44. These recesses are diametrically opposed to one another and have a longitudinal extension such as to extend over the two outlet openings pairwise of the transverse channels 38 and 39 and thereby enable a connection to be established between the two transverse channels 38 and 39. It will be understood that in order for this to be possible, the two transverse channels 38 and 39 should be generally parallel.

As before mentioned, the sleeve 42 can be rotated around the tube 30. When in the position illustrated in FIG. 7, the sleeve is located so that its recesses 43 and 44 do not coincide with the positions of the outlet openings of the transverse channels 38 and 39. In this position of the sleeve, no liquid or gas is able to flow between the transverse channels 38 and 39 and the flow through the valve is therefore shut-off.

When the sleeve 42 is turned through 90 degrees from the FIG. 7 position, the recesses 43 and 44 in the inner wall of the sleeve will be located opposite the openings in the tube side wall for the two transverse channels 38 and 39.

Liquid or gas is now able to flow from the volume container 3 (not shown) into the passageway 37, out through the first transverse channel 38, through the recesses 43 and 44 in the sleeve inner wall, through the second transverse channel 39, and finally out through the outlet channel 40. The valve is then open.

Figure 8:
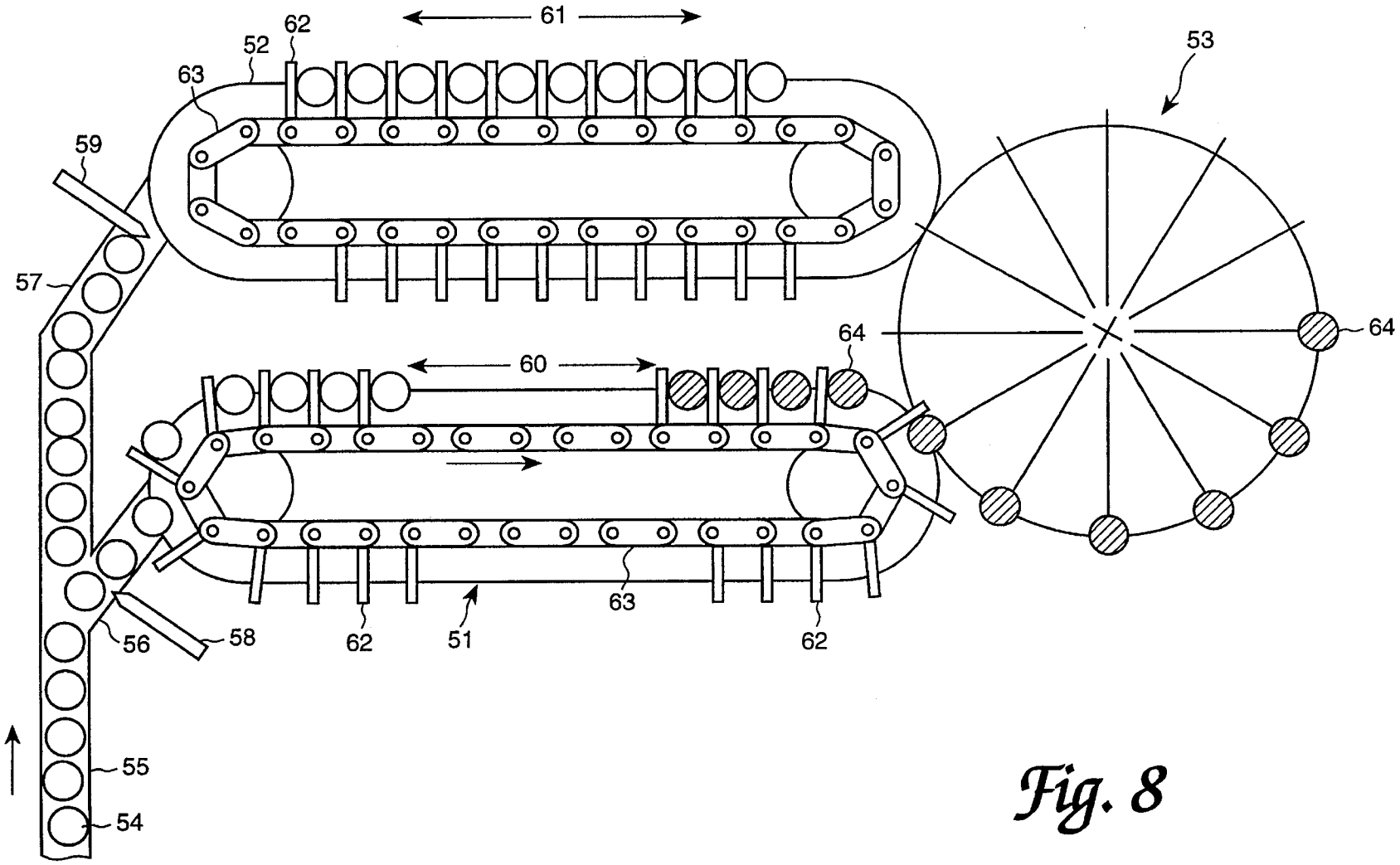
FIG. 8 illustrates schematically the construction and manner of operation of the conveyor.

FIG. 8 illustrates schematically one embodiment of the conveyor. The Figure illustrates the preferred embodiment in which the conveyor is duplicated and includes two conveying and filling units 51 and 52, both of which are connected to a container sealing apparatus 53. In the preferred embodiment of the invention, in which the containers to be filled are bottles, the sealing device is comprised of an apparatus for inserting stoppers into the bottles and optionally applying a capsule thereto.

Empty containers 54 are advanced along a conveyor path 55 to inlets 56 and 57 to the conveyors 51 and 52 respectively. Path blocking means 58 and 59 function to cause the containers 54 to be fed to either the conveyor 51 or the conveyor 52, for filling purposes.

Each of the conveyors 51 and 52 has a respective section 60 and 61 in which the containers are filled. These sections are preferably rectilinear and the containers remain stationary in said sections during a container filling operation.

The containers are advanced with the aid of dogging elements 62 which are connected to links 63 of an endless conveyor chain. The conveyor chain also includes surfaces on which the containers are supported during the transportation and filling of the containers.

Conveyors of the aforedescribed kind and construction are known to the skilled person and need not be described in more detail here.

Movement of the conveyors is controlled by the aforementioned programme mechanism, to which there is also connected a sensor which detects the position of the empty and the filled containers. This programme mechanism ensures that empty containers are located in a filling position when the point valves 6 for the volume containers are open and liquid exits therefrom, and that the other conveyor is moving at the same time, so that empty containers are advanced to the filling section and filled containers are moved out of the filling section to the container sealing apparatus 53.

Both conveyors 51 and 52 are connected to the sealing apparatus 53. In the most usual case, in which the containers are comprised of bottles, the sealing apparatus may have the form of a stoppering apparatus of known carousel kind.

Each of the conveyors 51 and 52 is preferably connected to the container sealing apparatus at a point at which the conveyor path curves to move in the opposite direction to the filled container transporting direction and returns to receive new containers to be filled. The speed of the containers is greatest at this turning point and shall be adapted to the container advancing speed of the sealing apparatus, this latter speed normally being greater than the linear transportation speed. In this way, the containers are gently accelerated from a stationary filling position to the maximum speed of entry to the sealing apparatus, thereby avoiding in a simple fashion such spillage as that which is likely to occur if the containers are accelerated too abruptly.

The filled and sealed containers are lead conventionally from the sealing apparatus 53 to following processing and treatment units, such as a sterilizing unit, a label-applying unit and a packaging unit.

The manner in which the apparatus operates will now be described with reference to the drawings.

FIG. 1 illustrates phase 1 of the filling sequence. The inert gas delivery valve 22 and the valve 11 in the return pipe through which product is returned from the collecting container 9 to the storage container 8 are both open, whereas the valve 7 in the delivery pipe through which product is delivered to the manifold 1 is closed, as are also the point valves 6 at respective volume container outlets. The inert gas valves 17 and 19 are also closed. The manifold 1 and the volume containers 3 are empty of liquid.

Figure 2:
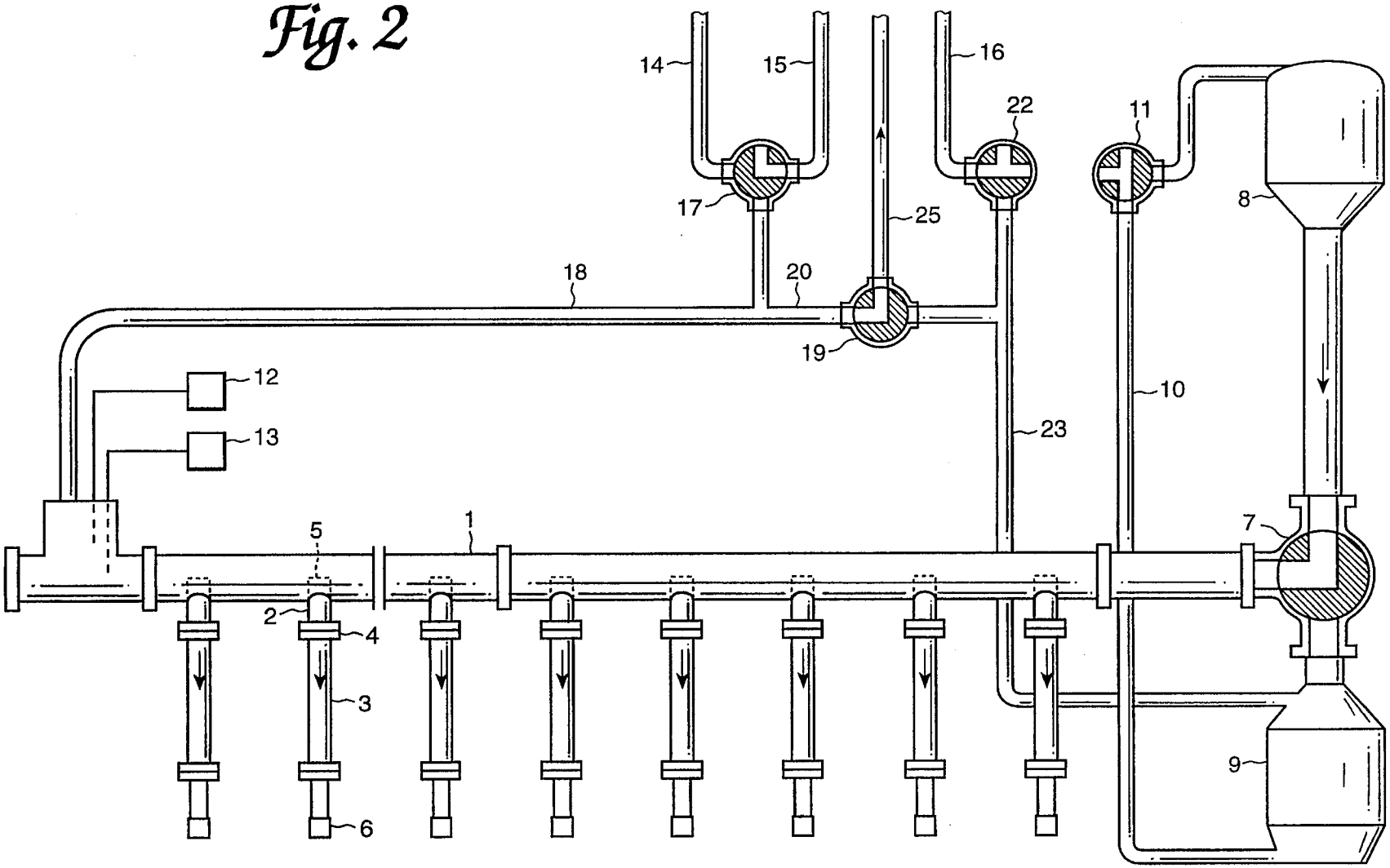

FIG. 2 illustrates phase 2 of the filling sequence. In this phase, the valve 7 is open so that liquid product is able to flow from the storage container 8 into the manifold 1. In order to enable this flow of liquid product to be achieved without requiring the use of pumps or some other complicated equipment, the storage container 8 is conveniently placed at a higher level than the manifold 1, so that product flow is achieved by the hydrostatic pressure thus generated.

The flow of liquid product may also be achieved, however, by applying gas pressure.

The valve 19 is open to enable the inert gas to flow out from the manifold 1 and through the vent pipe 25 to atmosphere or to a gas collecting means.

The valves 22 and 11 are closed to prevent the inert gas from leaving the collecting container 9.

The manifold 1, the outlet pipes 2 and the volume containers 3 are now filled with liquid product from the storage container 8. The product flow is interrupted when the level of product in the manifold 1 has reached the maximum level for which the sensor 12 is set. The sensor will then deliver a signal to the programme mechanism, which accordingly closes the valve 7 and therewith interrupts the flow of product.

Figure 3:
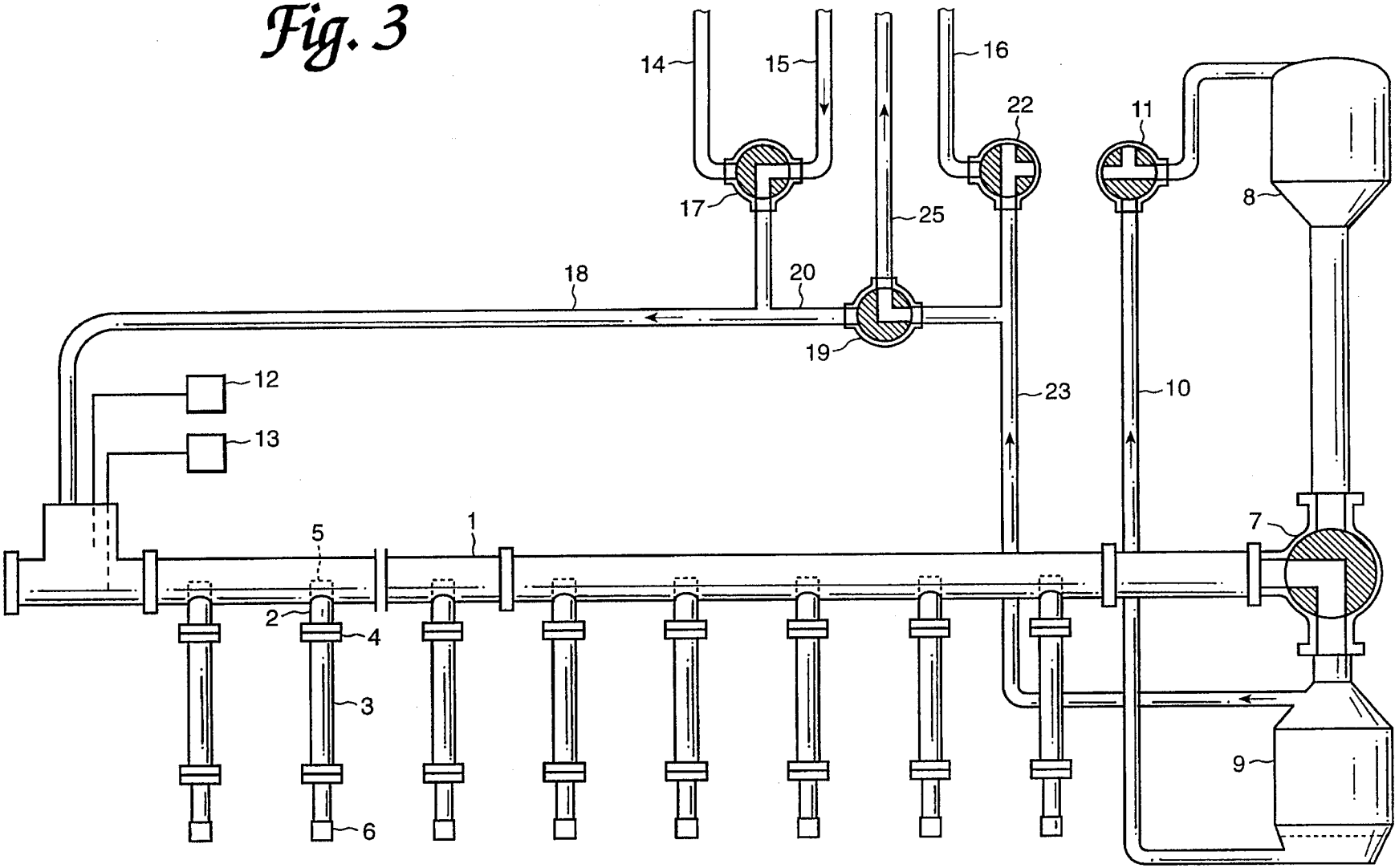

FIG. 3 illustrates phase 3 of the filling sequence. The valve 7 is now open to the collecting container, so that surplus product in the manifold 1 can flow out to the collecting container 9. The valve 17 is opened to deliver inert gas to the manifold through the pipe 15 and the pipe 18, and therewith facilitate emptying of the manifold. The valve 19 is open so that inert gas is able to flow from the collecting container 9 to atmosphere, through the pipe 23 and the pipe 25. The valves 11 and 22 are closed.

The outflow of liquid product from the manifold 1 is interrupted when the level of liquid product in the manifold has reached a minimum value, this minimum level being detected by the sensor 13 and lying beneath the level of the inlet opening of the inlet end 5 of the outlet pipes 2. This will ensure that the outlet pipes 2 and the volume containers 3 will all contain a specific quantity of liquid product.

Figure 4:
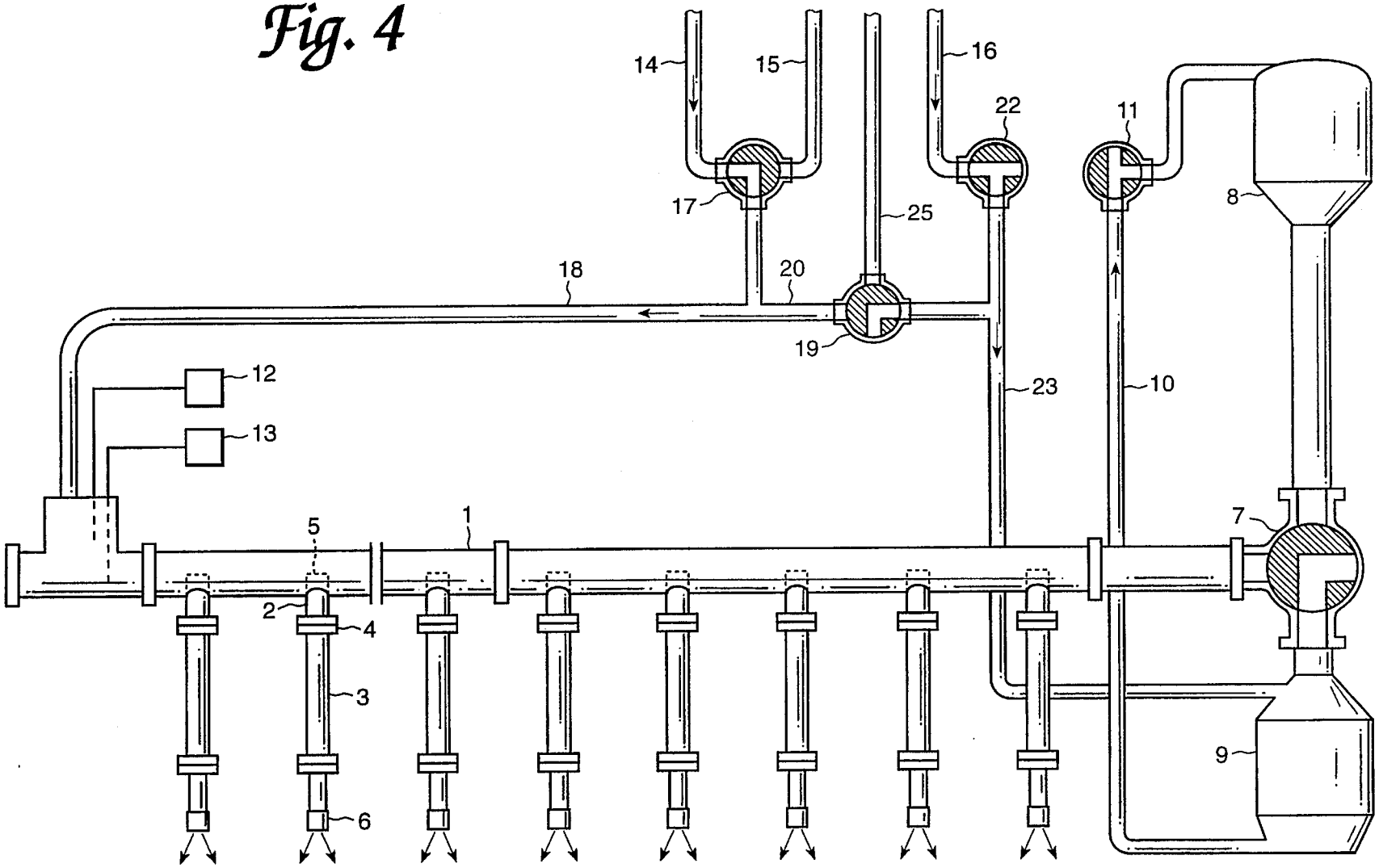

FIG. 4 illustrates phase 4 of the filling process. The valves 7 and 19 are now fully closed, whereas the valve 17 is open so that inert gas under pressure can be delivered to the manifold 1 and exert pressure on the liquid present in the outlet pipes 2 and the volume containers 3. The valves 6 in the volume containers are now open, so that liquid product will flow out from the volume containers, as illustrated by the arrows. Empty product containers are also positioned beneath the volume containers in readiness to be filled with liquid product during this phase of the filling process.

When all product has flown out from the volume containers 3 and into the product containers, the flow of inert gas is maintained for a further length of time, so that the volume containers 3 and the valves 6 will be blown clean of product residues. This eliminates subsequent dripping and spillage of the product.

As the containers are filled, the valve 22 is opened and a stream of inert gas is passed through the pipe 23 so as to displace surplus product from the collecting container 9 and return this surplus product to the storage container 8 through the return pipe 10.

The apparatus is now ready to carry out a new phase 1 of a new filling process, which can be repeated as often as desired.

The successive phases of the filling process are coordinated with a movement schedule for the container conveyors, as illustrated in FIG. 8, and are controlled by the programme mechanism.

FIG. 8 illustrates a preferred embodiment in which the conveyors are duplicated. Naturally, this implies that the apparatus for filling the product containers is also duplicated, such that one conveyor belongs to each filling apparatus.

FIG. 8 illustrates the manner in which empty containers 54 are advanced to two conveyors 51 and 52 via two feed paths 56 and 57. In the state of the apparatus illustrated in the Figure, the container feed to the conveyor 52 is shut-off by means of the feed blocker 59. The conveyor 52 is now stationary and filling of the containers located in the filling section 61 takes place.

In the feed path 56, containers are fed to the conveyor 51, past the open path blocker 58 and up to the container filling section 60. At the same time, filled containers 64 are moved from the filling section 60 to the container sealing apparatus 53. This takes place at the same time as the outlet pipes 2 and the volume containers 3 are filled during phases 2 and 3 of the filling apparatus belonging to this conveyor.

It is necessary for the conveyor and the container sealing apparatus to move at mutually the same peripheral speed as the filled containers are transferred from the container to said sealing apparatus, in order to ensure a disturbance-free function. Because this transfer is effected at a conveyor section in which the conveying direction takes a curved path, the containers will have automatically been accelerated to a speed which conforms to the peripheral speed of the container sealing apparatus. The filled containers will thus be accelerated gently as the conveyor is started-up subsequent to filling of the containers, therewith greatly reducing the risk of spillage and splashing of liquid product. This constitutes a highly essential advantage of the inventive apparatus and inventive method over the known standpoint of techniques.

The setting of the various valves in the apparatus for filling the product containers and for the delivery of inert gas, and also the movement schedule of the container conveying arrangement are controlled by a main programme mechanism, which is, in turn, controlled by signals that are received from the liquid level sensors in the manifold 1, from the sensors which detect the valve settings, and from the sensors which detect the positions of the empty and the filled containers in the conveyor arrangement. Such a programme mechanism is constructed in a manner known to the skilled person and is comprised of conventional components, and need not therefore be described in detail here. The actual programme mechanism may be placed at a distance from the filling and conveying apparatus, so as not to be necessarily affected by the stressful environment prevailing in the vicinity of the apparatus when in operation or by the apparatus cleaning operations that are frequently necessary.

It will be evident from the described manner of apparatus operation that an essential part of the liquid product is in movement during the filling process, since product is led from the storage container 8 to the manifold 1, and that product which is not introduced into the outlet pipes 2 and the volume containers 3 is carried away to the collecting container 9 and from there back to the storage container 8, through the return line 10. This represents a further essential advantage of the apparatus and inventive method, since the product is constantly remixed in this way and therewith greatly reducing the risk of sedimentation or flotation of emulsions or suspensions, for instance. Furthermore, it is easier to maintain the product at a constant temperature, and to this end an appropriate heat exchanger can be connected somewhere in the product flow path.

The individual components of the apparatus, such as valves, pipes and containers, and the various components of the conveyor arrangement are of a conventional kind and can be readily chosen by the skilled person. It must be observed that since the apparatus of a preferred embodiment is intended to fill bottles with pharmaceutical preparations, the apparatus must be constructed so as to be free from criticism from the aspect of hygiene and so that it can be easily cleaned and sterilized. This presents no difficulties to the person skilled in this field. Thus, the valves will preferably be pneumatically operated valves, since electric valves are less suitable for use under the working conditions of the apparatus.

Materials such as stainless steel, glass and various plastic materials have been found suitable for the various apparatus components. As before mentioned, ceramic materials have been found particularly suitable for the point valves 6, since ceramics are highly resistant to wear and can be worked to very close tolerances. This enables a seal to be obtained directly between ceramic surfaces without needing to include intermediate sealing material, which is highly beneficial from the aspect of hygiene.

In the aforegoing, the invention has been described primarily with respect to bottle-filling and subsequent bottle-stoppering processes. It will be understood, however, that the described and illustrated embodiments are only preferred embodiments and that the invention can be applied equally as well for filling other containers, for instance glass, plastic or metal containers. Those modifications required in such cases will be obvious to the person skilled in this art. The invention is thus only limited by the scope of the following claims.

We claim:

1. An apparatus for filling a succession of product containers each with liquid product, comprising a) a generally horizontal manifold or branched pipe which is connected to a storage container for the delivery of product to be filled into said product containers at a product container filling section, and to a collecting container for collecting residual product that is not introduced into the product containers, and which manifold is provided with at least one outlet each of which leads to a respective volume container for introducing product into a respective product container, each said volume container having a determined, volume which corresponds to a product volume to be introduced into each product container, and wherein the outlet end of each said volume container is provided with a point valve in a product conduit which adjusts the outflow of liquid product to the respective product container, and wherein each outlet opening of the manifold leading to a respective said volume container discharges on a level which lies above the bottom level of the manifold;

b) a product return line for returning product from said collecting container to said storage container;

c) sensor means which monitor the highest and the lowest permitted liquid levels in the manifold;

d) at least one connection, including at least one conduit having a respective valve, to an at least one source of gas under overpressure, said gas functioning to expel liquid product from each said volume container to each product container and to blow residue of liquid product out from the respective said point valve, so as to transport remaining liquid product from the manifold to the collecting container and to transport liquid product from said collecting container to said storage container;

e) a conveyor for advancing product containers to be filled in succession along a linear conveyor path and for delivering the filled product containers in succession to a container sealing apparatus;

f) sensor means which detect the positions of the product containers in the conveyor; and g) a program mechanism which receives impulses from said sensor means which detect the liquid level in the manifold, and also from said sensor means which detect the positions of the product containers on the conveyor, and on the basis of these impulses functions to control settings of said valves in said product and gas conduits and also to control movement of said conveyor.

2. Apparatus according to claim 1, wherein:

said storage container is disposed at a higher level than the manifold, so that product will flow gravitationally from said storage container to said manifold and each said volume container.

3. Apparatus according to claim 1, wherein:

each said point valve at each said volume container outlet comprises a tube fitted with a respective ring which in one position functions to seal off at least one product outflow opening and which when moved along said tube or rotated around said tube to another position exposes said at least one to permit product to exit therethrough.

4. Apparatus according to claim 3, wherein:

each said point valve is made of ceramic material.

5. Apparatus according to claim 1, wherein:

said conveyor is constructed so that the filled product containers will be gently accelerated from said container filling section to an infeed to a container sealing apparatus.

6. Apparatus according to claim 5, wherein:

said container filling section is linear and said conveyor has a curved conveyor section located downstream of said linear container filling section and upstream of a point at which the filled product containers are fed into a container sealing apparatus, so as to impart gentle acceleration to the filled containers.

7. Apparatus according to claim 1, wherein:

said apparatus is duplicated such that product containers are filled in one said apparatus while the respective conveyor is stationary at the same time as empty product containers are fed by the conveyor of the second apparatus to its filling section and filled containers are fed to a container sealing apparatus.

* * * * *